US009920266B2

(12) United States Patent
Khan et al.

(10) Patent No.: US 9,920,266 B2
(45) Date of Patent: Mar. 20, 2018

(54) METHOD AND APPARATUS FOR MIXING AND ATOMIZING A HYDROCARBON STREAM USING A DILUENT/DISPERSION STREAM

(71) Applicant: INDIAN OIL CORPORATION LIMITED, Mumbai (IN)

(72) Inventors: Shoeb Hussain Khan, Faridabad (IN); Bidyut De, Faridabad (IN); Satheesh Vetterkunnel Kumaran, Faridabad (IN); Manoj Kumar Yadav, Faridabad (IN); Debasis Bhattacharyya, Faridabad (IN); Brijesh Kumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 182 days.

(21) Appl. No.: 15/159,771

(22) Filed: May 19, 2016

(65) Prior Publication Data

US 2016/0340598 A1 Nov. 24, 2016

(30) Foreign Application Priority Data

May 20, 2015 (IN) ..... 1987/MUM/2015

(51) Int. Cl.
*B01F 3/04* (2006.01)
*C10G 75/04* (2006.01)
(Continued)

(52) U.S. Cl.
CPC ..... *C10G 75/04* (2013.01); *B01F 3/04049* (2013.01); *B01F 5/045* (2013.01);
(Continued)

(58) Field of Classification Search
CPC ..... B01F 3/04049; B01F 3/04063; B01F 5/0451; B01F 5/0458; B01F 5/0463;
(Continued)

(56) References Cited

U.S. PATENT DOCUMENTS 5,289,976 A * 3/1994 Dou ..... B01J 8/1827 239/431
5,318,691 A * 6/1994 Muldowney ..... C10G 11/18 208/113
5,794,857 A 8/1998 Chen et al.
6,093,310 A * 7/2000 Swan ..... C10G 11/18 208/113
(Continued)

FOREIGN PATENT DOCUMENTS

JP 2006181424 * 7/2006

*Primary Examiner* — Charles Bushey
(74) *Attorney, Agent, or Firm* — Maschoff Brennan

(57) ABSTRACT

The present invention relates to an apparatus and method for mixing and atomizing a hydrocarbon stream using a diluent/dispersion stream. The apparatus includes an inner conduit having an inlet for receiving the diluent/dispersion stream; an outer conduit having an inlet for receiving the hydrocarbon stream and an outlet for dispensing a mixture including the hydrocarbon and the dispersion/diluent streams; the outer conduit concentric to the inner conduit to define at least a first annular space and a second annular space; the first annular space being located downstream of the inlet of the outer conduit, the first annular space enabling formation of a thin film of the hydrocarbon stream between an outer surface of the inner conduit and an inner surface of the outer conduit; the second annular space being located downstream of the first annular space, the second annular space having a width greater than a width of the first annular space; and the inner conduit located at about the second annular space includes a first set orifices disposed on a periphery thereof for dispensing a first portion of the dispersion/diluent stream into the thin film of hydrocarbon stream to cross-shear the thin film and form the mixture including the hydrocarbon and the dispersion/diluent streams.

9 Claims, 6 Drawing Sheets

(51) Int. Cl.

| | |
|---|---|
| ***B01F 5/04*** | (2006.01) |
| ***B01F 5/06*** | (2006.01) |
| ***C10G 11/18*** | (2006.01) |
| *B01F 13/10* | (2006.01) |
| *B01F 15/02* | (2006.01) |

(52) U.S. Cl.
CPC ..... *B01F 5/0451* (2013.01); *B01F 5/0458* (2013.01); *B01F 5/0463* (2013.01); *B01F 5/061* (2013.01); *C10G 11/18* (2013.01); *B01F 2013/1052* (2013.01); *B01F 2015/0221* (2013.01); *C10G 2300/80* (2013.01)

(58) Field of Classification Search
CPC .. B01F 5/061; B01F 5/045; B01F 2013/1052; B01F 2015/0221; C10G 11/18; C10G 75/04; C10G 2300/80
USPC ..... 261/78.2, 79.2
See application file for complete search history.

(56) References Cited

U.S. PATENT DOCUMENTS

| | | | | |
|---|---|---|---|---|
| 6,142,457 | A | 11/2000 | Holtan et al. | |
| 6,170,979 | B1 * | 1/2001 | Smeaton | B01F 5/0451 366/173.1 |
| 6,902,707 | B2 | 7/2005 | Adamson et al. | |
| 8,163,807 | B2 * | 4/2012 | Katsuhara | B01F 3/0807 366/76.2 |
| 2016/0199805 | A1 * | 7/2016 | Lacroix | B01J 8/1827 239/424.5 |
| 2016/0354748 | A1 * | 12/2016 | De | B01J 8/24 |

* cited by examiner

5(a)

5(c)

5(b)

METHOD AND APPARATUS FOR MIXING AND ATOMIZING A HYDROCARBON STREAM USING A DILUENT/DISPERSION STREAM

TECHNICAL FIELD

The present invention relates to an apparatus and method for mixing and atomizing a hydrocarbon stream using a diluent/dispersion stream.

BACKGROUND

Fluid catalytic cracking (FCC) is employed in petroleum refineries to convert high boiling hydrocarbon fractions of crude oil to more valuable products like Liquefied Petroleum Gas (LPG), gasoline and diesel. For this, heavy crude oil is chemically cracked into lighter hydrocarbon fractions having comparatively smaller chain of carbon atoms with the help of one or more catalysts. These high boiling hydrocarbons fractions are then introduced, in multiple streams, into a riser reactor section to undergo catalytic cracking. This results in lighter hydrocarbon fractions, which may be further sent to a fractional distillation column for extracting aforementioned valuable products.

In Fluid Catalytic Cracking (FCC), the atomization of hydrocarbon feed is very critical for contacting the hydrocarbon feed with catalyst particles. A uniform and narrow distribution of droplet size helps in faster vaporization of hydrocarbon feed leading to reduction in coke and better product selectivity.

In FCC, catalyst particles having particle size distribution in the range of 0-150 μm with average particle size of 70-90 μm are used to carry out the cracking reaction of hydrocarbon feed. Naphtha, which is a light hydrocarbon feed, normally has a boiling point up to 180 degree celsius. Heavy hydrocarbons such as vacuum residue normally boils over 370 degrees Celsius.

The feed is injected into the moving catalyst particles (said catalyst particles having temperature greater than 650 degree Celsius) from an apparatus for cracking in the form of droplets and the cracking of these feed molecules takes place in vapour phase on the active catalyst surface in a very short period of time. If the feed is injected without proper atomization, the contact of the feed droplets and catalyst particles will be poor and the heat transfer from the hot catalyst particle to feed will be less, resulting in low vaporisation of feed. Therefore, the hydrocarbon feed is required to be atomized into fine droplets which are of similar sizes of catalyst particles. This essentially helps to increase the contact of feed with the catalyst particles and the transfer of heat from the catalyst to feed for faster vaporization.

Uniform feed atomization will favour catalytic cracking, resulting in more desirable products and decrease in production of undesirable product (coke and dry gas). While designing an apparatus for catalytic cracking, the objective is to generate a narrow distribution of droplet size of hydrocarbon feed with sauter mean diameter (SMD) nearly equal to the average particle size of the catalyst particles. Bigger droplets will cause more penetration into the catalyst bed in riser and form coke and dry gas. Smaller droplet size will cause less penetration.

U.S. Pat. No. 6,142,457 describes a nozzle for atomization of a liquid stream. The nozzle comprises a primary conduit and a secondary conduit. The primary conduit is concentric to the secondary conduit and defines an annular space and a mixing zone. The hydrocarbon feed is introduced in the annular space between the primary conduit and the secondary conduit and the dispersion medium is introduced into the secondary conduit. In the mixing zone, the hydrocarbon stream is joined with the dispersion stream in a manner to force the hydrocarbon stream into the general shape of a thin film that surrounds the dispersion medium. The inner surface of the primary conduit within the mixing zone is a tapered surface that reduces the cross-sectional area of the primary conduit in the mixing zones to form the liquid film therein which is atomized as it exits the primary conduit outlet.

U.S. Pat. No. 6,902,707 describes a FCC feed injector wherein the atomizing medium is injected at multiple stages to decrease the feed droplet size. The feed injector comprises a plurality of inlets and plurality of mixing zones. The mixing zones are in fluid connection with each other. In one embodiment, the injector comprises an external sparger configured to define a first mixing zone. In another embodiment, the injector comprises a mixing tee configured to define the first mixing zone. The first mixing zone receives the first atomizing fluid and the hydrocarbon feed to form a first mixture. The second mixing zone receives a second atomizing fluid and the mixture from the first mixing zone to form a second mixture. The second mixture is, thereafter, dispensed into the riser reactor zone in a pre-determined spray pattern.

U.S. Pat. No. 5,794,857A describes a feed nozzle assembly for introducing steam and a heavy petroleum hydrocarbon into a reactor. The feed nozzle assembly comprises a hydrocarbon conduit and a diluent/dispersion conduit. The hydrocarbon conduit is concentric to the dispersion conduit to define an annular passage for introducing the hydrocarbon feed. The nozzle further comprises a first nozzle tip and a second nozzle tip. The first nozzle tip is attached to an outer end of the dispersion conduit. The first nozzle tip comprises two rows having a plurality of passageways therein for passage of the dispersion stream out of said dispersion conduit into said heavy petroleum hydrocarbon passing through said hydrocarbon conduit, thereby resulting in a mixture of steam and hydrocarbon. The second nozzle tip is attached to the hydrocarbon conduit for dispensing the mixture of steam and hydrocarbon out of said feed nozzle assembly.

As can be seen, apparatus disclosed in prior arts fall short in completely and efficiently atomizing a hydrocarbon feed. One reason for said inefficient atomization may be that, in most of the prior arts, the onset of mixing and breaking up of the hydrocarbon stream does not start at the initial length of the apparatus and therefore there is an improper mixing/atomization of the hydrocarbon feed with the diluent/dispersion stream at the final stages. Even if onset of atomization occurs at initial length of the apparatus, none of the available prior arts enable formation of a thin film of hydrocarbon at the initial length to provide an enhanced interface area of the hydrocarbon film for increasing the mixing of hydrocarbon with dispersion/diluent stream. Due to inefficient mixing at the initial length, the apparatus of prior arts have to incorporate number of mixing zones which unnecessarily complicates the designs of the apparatus. Inefficient atomization leads to non-uniformity in terms of diameter and velocity of the droplets of the atomized hydrocarbon feed. Moreover, it takes considerable time for such hydrocarbon feeds to vaporize. Delayed vaporization of the hydrocarbon feed in turn leads to slow and inadequate absorption of heat by the hydrocarbon droplets inside the riser reactor, thus leading to undesirable thermal cracking and excessive production of by-products such as coke.

Therefore, there is a constant need for simple and improved apparatus which can facilitate the onset of atomization at initial stages and generate droplets of hydrocarbon feed having SMD lesser than those available in the prior art, preferably in the range nearing the average particle size of catalyst particles.

SUMMARY OF THE INVENTION

In accordance with the purposes of the invention, the present invention as embodied and broadly described herein, comprises an apparatus and method thereof for mixing and atomizing a hydrocarbon stream using a diluent/dispersion stream.

The apparatus for mixing and atomizing a hydrocarbon stream using a diluent/dispersion stream comprises an inner conduit having an inlet for receiving the diluent/dispersion stream and an outer conduit having an inlet for receiving the hydrocarbon stream. The outer conduit further defines an outlet for dispensing a mixture comprising the hydrocarbon and the dispersion/diluent streams. The outer conduit is concentric to the inner conduit to define at least a first annular space and a second annular space. The second annular space has a width greater than a width of the first annular space. The first annular space is located downstream the inlet of the outer conduit and enables formation of a thin film of the hydrocarbon stream between an outer surface of the inner conduit and an inner surface of the outer conduit. The second annular space is located downstream of the first annular space. The portion of the inner conduit located at about the second annular space comprises a first set orifices disposed on a periphery thereof for dispensing a first portion of the dispersion/diluent stream into the thin film of hydrocarbon stream to form the mixture comprising the hydrocarbon and the dispersion/diluent streams.

The method for mixing and atomizing a hydrocarbon stream using a diluent/dispersion stream comprises: providing the apparatus in accordance with the embodiments of the present invention, introducing hydrocarbon stream and diluent/dispersion stream in said apparatus. The apparatus in accordance with the invention, as discussed, comprises an inner conduit having an inlet for receiving the diluent/dispersion stream and an outer conduit having an inlet for receiving the hydrocarbon stream. The outer conduit further defines an outlet for dispensing a mixture comprising the hydrocarbon and the dispersion/diluent streams. The outer conduit is concentric to the inner conduit to define at least a first annular space and a second annular space. The second annular space has a width greater than a width of the first annular space. The first annular space is located downstream the inlet of the outer conduit and enables formation of a thin film of the hydrocarbon stream between an outer surface of the inner conduit and an inner surface of the outer conduit. The second annular space is located downstream of the first annular space. The portion of the inner conduit located at about the second annular space comprises a first set orifices disposed on a periphery thereof for dispensing a first portion of the dispersion/diluent stream into the thin film of hydrocarbon stream to form the mixture comprising the hydrocarbon and the dispersion/diluent streams.

These and other aspects as well as advantages will be more clearly understood from the following detailed description taken in conjugation with the accompanying drawings and claims.

BRIEF DESCRIPTION OF THE ACCOMPANYING DRAWINGS

To further clarify advantages and aspects of the invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings in accordance with various embodiments of the invention, wherein.

Figure 5:
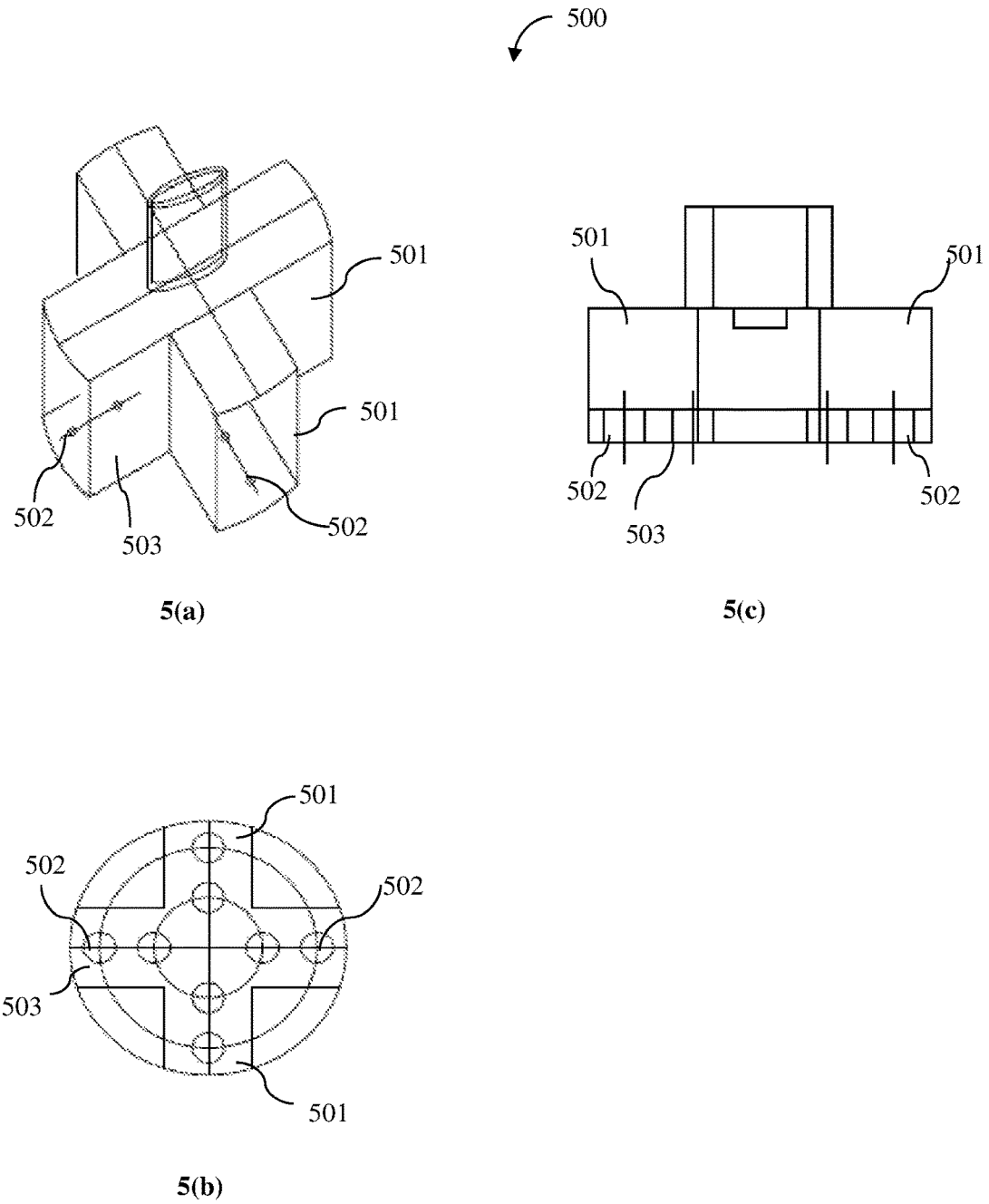

FIGS. 5 (*a*), 5 (*b*) and 5(*c*) illustrates various views of the sparging means 500, in accordance with the embodiments of the present invention.

Figure 6A:
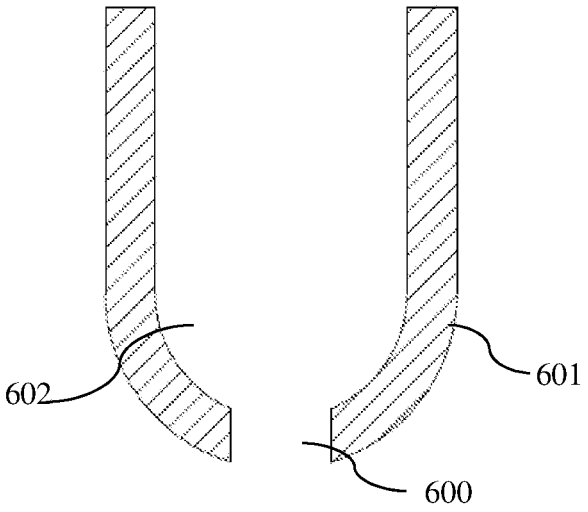
Figure 6B:
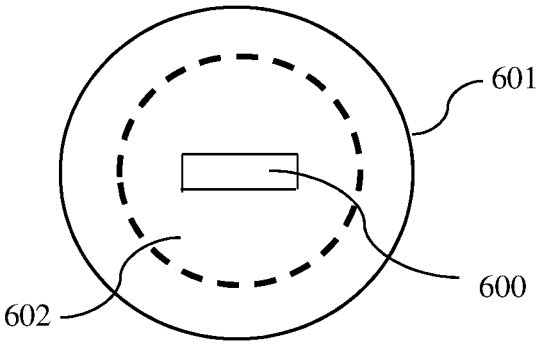

FIG. 6*a* illustrates a schematic view of the outlet end of the outer conduit, thereby depicting the tip region of the apparatus. FIG. 6*b* illustrates a bottom view of the outlet end of the outer conduit, thereby depicting a bottom view of tip region of the apparatus.

It may be noted that to the extent possible, like reference numerals have been used to represent like elements in the drawings. Further, those of ordinary skill in the art will appreciate that elements in the drawings are illustrated for simplicity and may not have been necessarily drawn to scale. For example, the dimensions of some of the elements in the drawings may be exaggerated relative to other elements to help to improve understanding of aspects of the invention. Furthermore, the one or more elements may have been represented in the drawings by conventional symbols, and the drawings may show only those specific details that are pertinent to understanding the embodiments of the invention so as not to obscure the drawings with details that will be readily apparent to those of ordinary skill in the art having benefit of the description herein.

DETAILED DESCRIPTION

It should be understood at the outset that although illustrative implementations of the embodiments of the present disclosure are illustrated below, the present invention may be implemented using any number of techniques, whether currently known or in existence. The present disclosure should in no way be limited to the illustrative implementations, drawings, and techniques illustrated below, including the exemplary design and implementation illustrated and described herein, but may be modified within the scope of the appended claims along with their full scope of equivalents.

The term "some" as used herein is defined as "none, or one, or more than one, or all." Accordingly, the terms "none," "one," "more than one," "more than one, but not all" or "all" would all fall under the definition of "some." The term "some embodiments" may refer to no embodiments or to one embodiment or to several embodiments or to all embodiments. Accordingly, the term "some embodiments"

is defined as meaning "no embodiment, or one embodiment, or more than one embodiment, or all embodiments".

The terminology and structure employed herein is for describing, teaching and illuminating some embodiments and their specific features and elements and does not limit, restrict or reduce the spirit and scope of the claims or their equivalents.

More specifically, any terms used herein such as but not limited to "includes," "comprises," "has," "consists," and grammatical variants thereof do NOT specify an exact limitation or restriction and certainly do NOT exclude the possible addition of one or more features or elements, unless otherwise stated, and furthermore must NOT be taken to exclude the possible removal of one or more of the listed features and elements, unless otherwise stated with the limiting language "MUST comprise" or "NEEDS TO include".

Whether or not a certain feature or element was limited to being used only once, either way it may still be referred to as "one or more features" or "one or more elements" or "at least one feature" or "at least one element." Furthermore, the use of the terms "one or more" or "at least one" feature or element do NOT preclude there being none of that feature or element, unless otherwise specified by limiting language such as "there NEEDS to be one or more . . . " or "one or more element is REQUIRED".

Unless otherwise defined, all terms, and especially any technical and/or scientific terms, used herein may be taken to have the same meaning as commonly understood by one having an ordinary skill in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Use of the phrases and/or terms such as but not limited to "a first embodiment," "a further embodiment," "an alternate embodiment," "one embodiment," "an embodiment," "multiple embodiments," "some embodiments," "other embodiments," "further embodiment", "furthermore embodiment", "additional embodiment" or variants thereof do NOT necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

Figure 1:
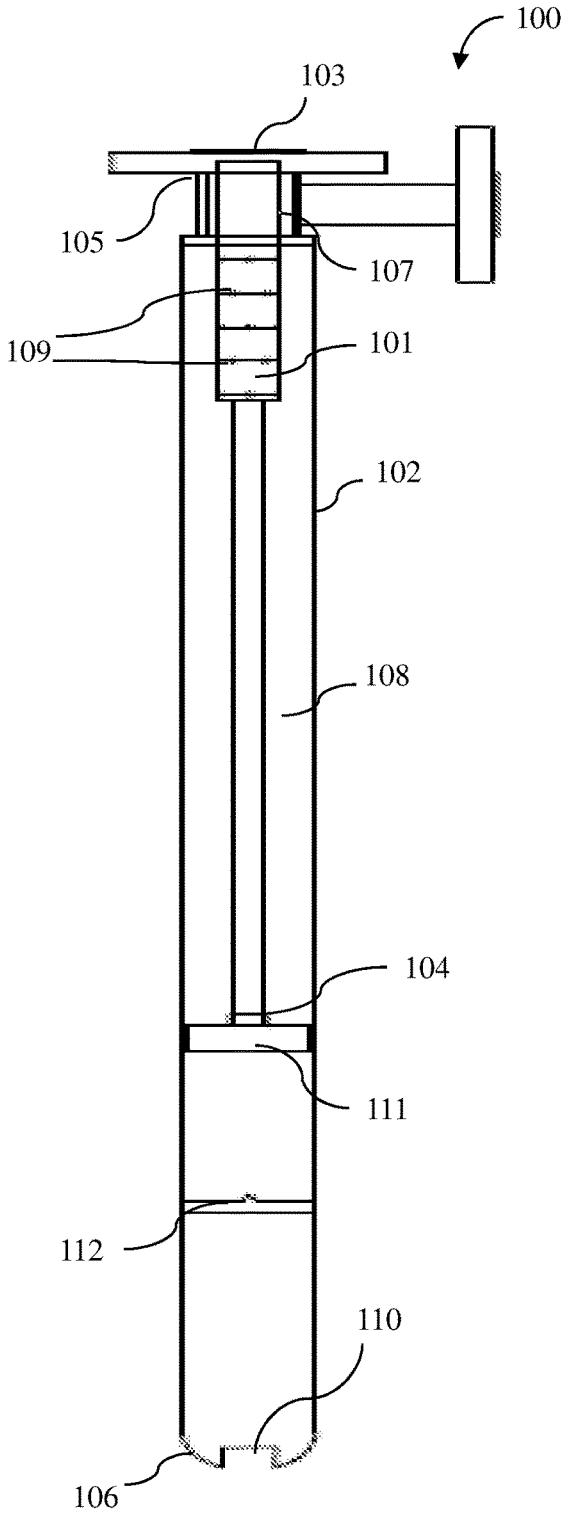
FIG. 1 illustrates a schematic view of an apparatus 100 for mixing and hydrocarbon stream using a diluent/dispersion stream, in accordance with one or more embodiments of the present invention.

FIG. 1 illustrates a schematic view of an apparatus 100 for mixing and hydrocarbon stream using a diluent/dispersion stream, in accordance with one or more embodiments of the present invention.

The apparatus 100 comprises an inner conduit 101 and an outer conduit 102. The inner conduit 101 defines a first end 103, a second end 104 and a hollow channel extending there between. The first end may 103 act as an inlet for receiving the dispersion stream/diluent stream. It is to be understood that the first end 103 may not always act as an inlet and a further one or more inlets may be located at about the first end of the inner conduit for introducing the diluent/dispersion stream. The diluent/dispersion stream includes steam, nitrogen, fuel gas and other suitable diluent/dispersion medium known in the art.

The outer conduit 102, like inner conduit 101, defines a first end 105, a second end 106 and a hollow channel extending there between. The outer conduit 102 surrounds the inner conduit 101 to define at least a first annular space 107 and a second annular space 108. The first end 105 of the outer conduit may act as an inlet for receiving the hydrocarbon stream. It is to be understood one or more inlets may be located at about the first end of the outer conduit for introducing the hydrocarbon stream. The hydrocarbon stream includes coker naphta, coker gas oil, vacuum gas oil (VGO), hydro treated vacuum gas oil, hydrocracker bottom, straight run naphta, visbreaker naphtha and so on.

The first annular space 107 is located downstream to the one or more inlets of the outer conduit 102. The second annular space 108 is located downstream the first annular space 107. The second annular space 108 has a width greater than a width of the first annular space 107. The reduced first annular space enables the formation of a thin film of the hydrocarbon stream between an outer surface of the inner conduit and an inner surface of the outer conduit. The formation of the thin film results in enhanced interface area for increased mixing of the hydrocarbon stream with the diluent/dispersion stream. The inner conduit 101 further comprises a first set orifices 109 disposed on a periphery thereof to dispense a first portion of the diluent/dispersion stream flowing through the inner conduit 101. The first sets of orifices 109 are located downstream the first annular space 107 and are adapted for dispensing a first portion of the dispersion/diluent stream into the thin film of hydrocarbon stream to form a mixture comprising the hydrocarbon and the dispersion/diluent streams. The said mixture is formed at about the second annular space 108. The said mixture is dispensed at about the second end 106 of the outer conduit 102 thereby providing atomized feed droplets. In one example, the mixture comprising the hydrocarbon and the diluent stream is ejected at a tip 110 of the apparatus thereby providing atomized droplets. The said tip 110 of the apparatus may comprise one or more openings.

The said apparatus 100 may further comprise at least one sparging means 111 for further mixing of the mixture comprising the hydrocarbon stream and the diluent stream. The said at least one sparging means are located downstream of said inner conduit and are in fluid connection with said inner conduit. Each sparging means 111 includes a plurality of outwardly extending arms spaced apart at a pre-determined angle, said plurality of arms defining a fluid passage there through and terminating at the inner surface of the outer conduit. The sparging means 111 further comprises a second set of orifices for dispensing a second portion of the diluent/dispersion stream into the mixture comprising the hydrocarbon stream and the diluent/dispersion stream. The second sets of orifices are located on the plurality of arms.

The said apparatus 100 may further comprise a flow diverter 112, said flow diverter 112 adapted for dividing the mixture comprising the hydrocarbon and the dispersion/diluent streams into a plurality of streams. The said flow diverter is located downstream of the inner conduit. In case the apparatus has sparging means, the flow diverter is located downstream said sparging means.

During operation, the diluent/dispersion stream and the hydrocarbon stream is pre-heated and introduced into the inner conduit and the outer conduit respectively. In one example, the temperature of the diluent/dispersion stream is in the range of 150 degrees celsius to 350 degrees celsius and the temperature of the hydrocarbon stream is in the range of 150 degrees celsius to 400 degree celsius. The dispersion/diluent stream is introduced into the inner conduit 101 by means of one or more inlets located at about the first end 103 of the inner conduit 101. The hydrocarbon stream is introduced into the outer conduit 102 by means of one or more inlets located at about the first end 105 of the outer conduit 102. The hydrocarbon stream, after introduction into the outer conduit, enters the first annular space 107. As already stated, the width of the first annular space is lesser than the width of the second annular space, said reduction in width of the first annular space leading to formation of a thin film between the outer surface of the inner conduit 101 and inner surface of the outer conduit 102. The reduction in the first annular space results in enhanced interface area of the hydrocarbon stream with the dispersion/diluent stream. The said thin film of the hydrocarbon stream is cross sheared by the diluent/dispersion stream coming out through the first set of orifices 109 disposed on the periphery of said inner conduit 101. In one example, the said first set of orifices 109 dispenses the first portion of the diluent/dispersion stream at a high velocity and at an angle in the range of 30 degree to 120 degree. The cross shearing of the thin film of hydrocarbon breaks the said hydrocarbon film into elongated particles which marks the onset of the atomization.

The said first annular space 107 for forming a thin film of hydrocarbon and a first set of orifices 109 for cross shearing the film of hydrocarbon results in the optimum mixing of the hydrocarbon stream and the diluent/dispersion stream at the initial length of the apparatus 100. Such initial mixing contributes to enhanced breakup of the hydrocarbon stream. In one example, the first set of orifices 109 is distributed along a length of the inner conduit 101. The distribution of the first set of orifices 109 along the length of the inner conduit results in continuous dispensing of the diluent/dispersion stream into downwardly moving hydrocarbon film. Such dispensing of the diluent/dispersion stream along the length of the inner conduit 101 progressively reduces the viscosity of the downwardly moving thin film of the hydrocarbon stream.

In one example, the method further comprises division of the mixture into at least a first flow and a second flow and introduction of the second portion of the dispersion/diluent stream into the at least first flow and second flow. The division of the mixture into at least the first flow and the second flow is achieved by means of the plurality of arms of the sparging means. The introduction of the second portion of the diluent/dispersion stream into said at least first flow and the second flow is achieved by means of second set of orifices located on the plurality of arms. The introduction of the second portion of the diluent dispersion stream into the mixture leads to further breaking of the hydrocarbons in the at least first flow and second flow leading to more uniform distribution and mixing of the hydrocarbon with the diluent/dispersion stream.

It is to be understood that the second portion of the diluent/dispersion stream can be divided into plurality of portions and can be introduced into the mixture at different stages. Each time a portion of the diluent/dispersion stream is introduced into the mixture, the viscosity of the mixture is progressively reduced. The diluent/dispersion stream can be introduced at various stages by means of a plurality of the sparging means. In one example, the second portion of the diluent/dispersion stream in dispensed through one sparging means. In another example, the second portion of the diluent/dispersion stream is divided into a plurality of the diluent/dispersion stream and is dispensed through a plurality of the sparging means. Each of the plurality of the sparging means is located downstream of the inner conduit and flow connected to the inner conduit to receive a portion of the diluent/dispersion stream.

Figure 2:
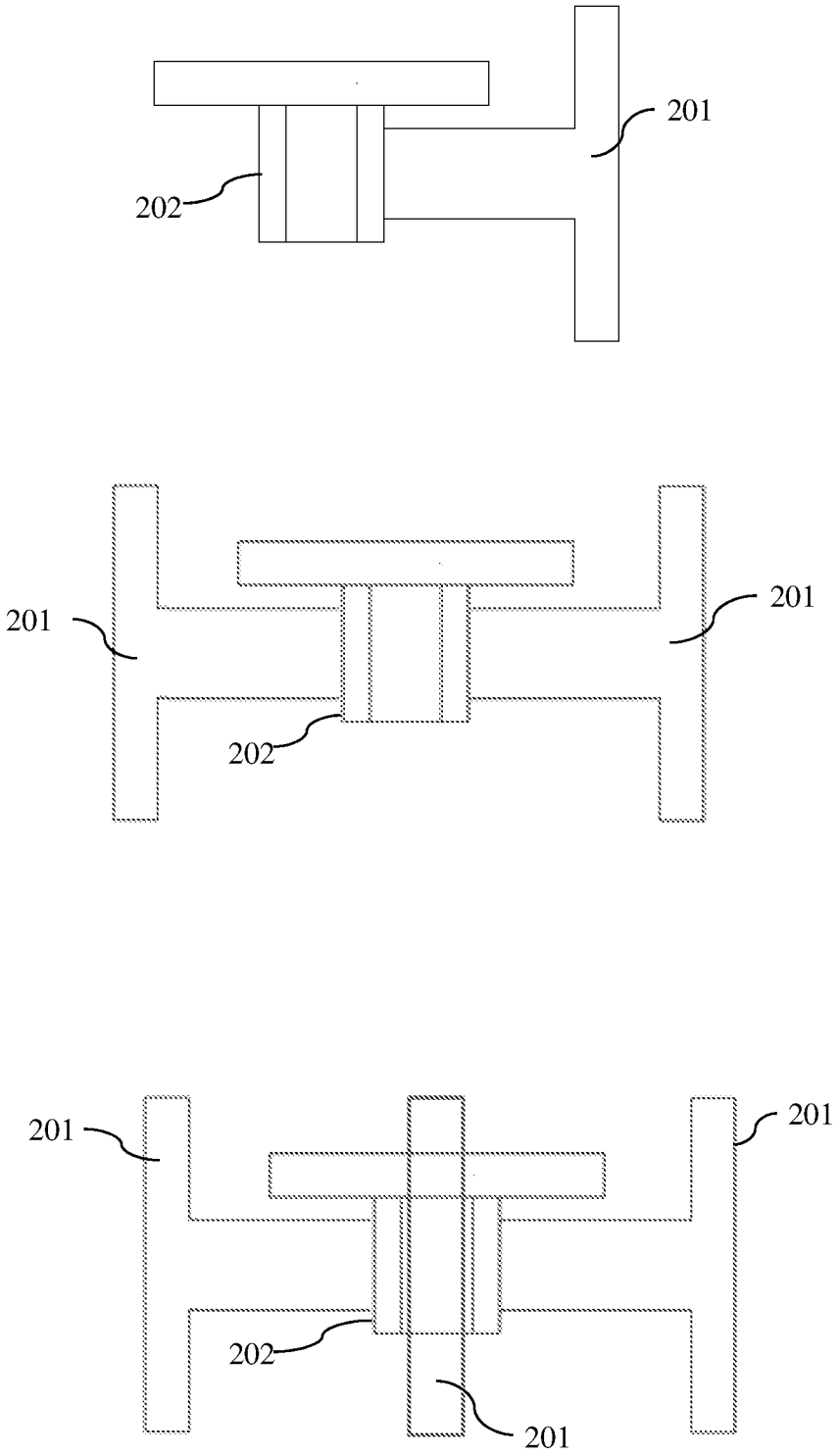
FIG. 2 illustrates a schematic view of one or more inlets located at about the first end of the outer conduit of the apparatus, in accordance with the embodiments of the present invention.

FIG. 2 illustrates a schematic view of one or more inlets located at about the first end of the outer conduit of the apparatus, in accordance with the embodiments of the present invention.

As shown in the FIG. 2, there may be one or more inlets 201 located at the first end of the outer conduit 202 for introduction of hydrocarbon stream into the apparatus. The plurality of inlets 201 may be distributed along the periphery of the outer conduit 202 at a pre-determined angle. In one example, two inlets are spaced apart at an angle of 180 degrees. In one example, three inlets are spaced apart at an angle of 120 degrees. In one example, four inlets are spaced apart at an angle of 90 degrees. It is to be understood that there may be many such combination of inlets for introduction of hydrocarbon stream into the apparatus.

Figure 3:
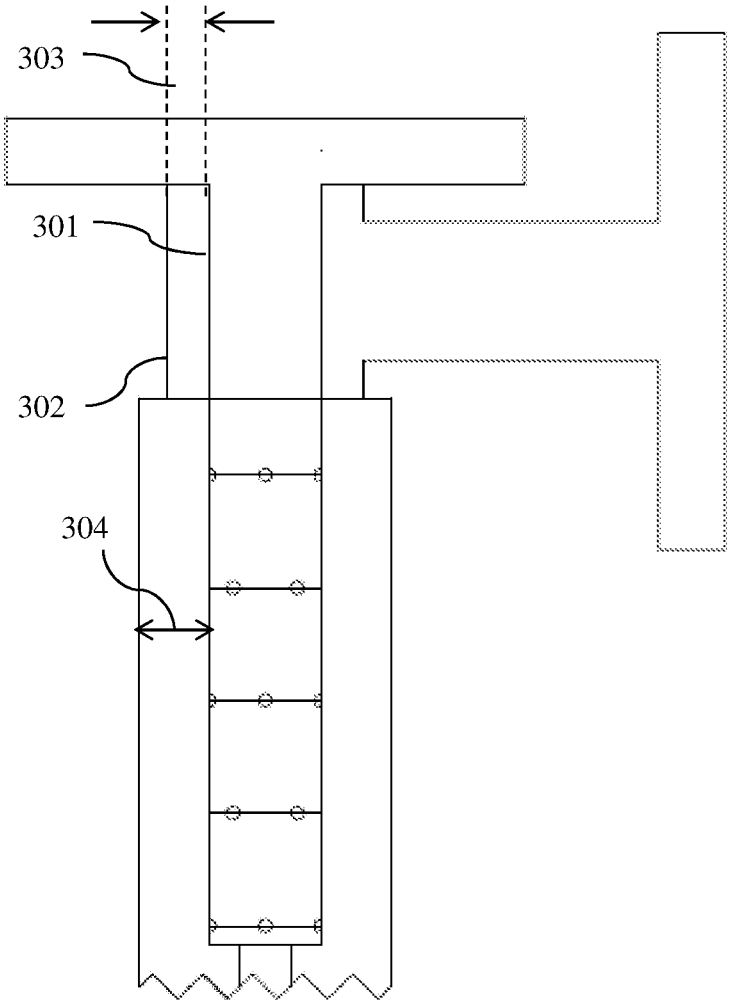
FIG. 3 illustrates a schematic view of the first annular space and the second annular space, in accordance with the embodiments of the present invention.

FIG. 3 illustrates a schematic view of the first annular space and the second annular space, in accordance with the embodiments of the present invention.

As shown in FIG. 3, the outer conduit 302 surrounds the inner conduit 301 to define at least a first annular space 303 and a second annular space 304. As can be seen from the Figure, the width of the second annular space is greater than the width of the first annular space. The width of the first annular space 303 is determined based on flow characteristics of the hydrocarbon stream and should enable formation of a thin hydrocarbon film between the outer surface of the inner conduit and the inner surface of the outer conduit.

Figure 4:
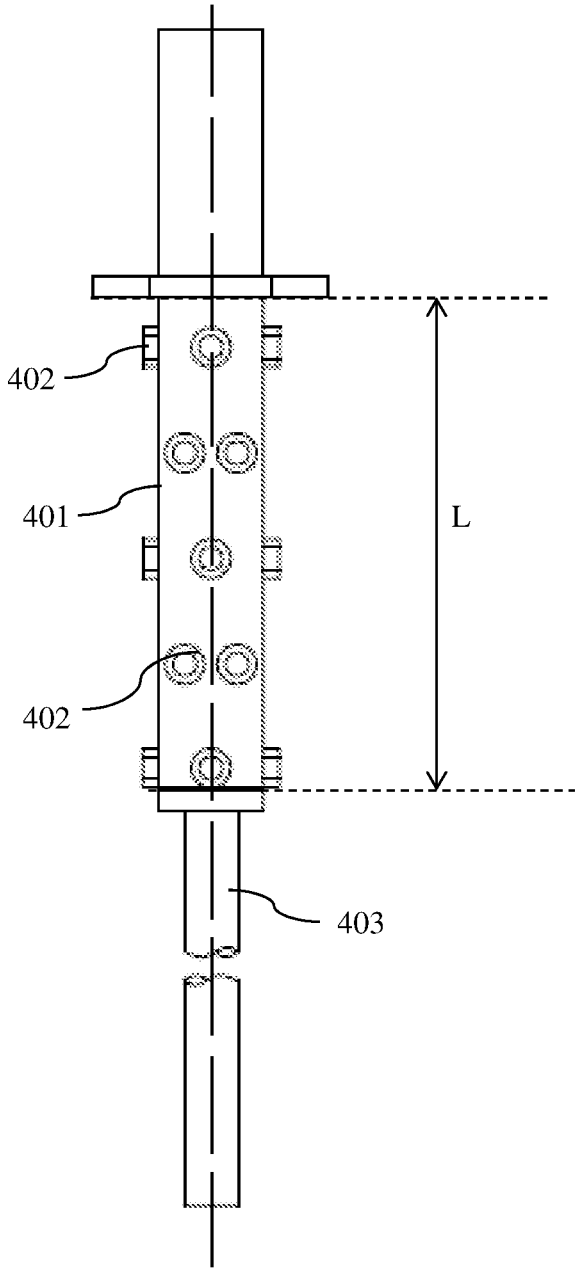
FIG. 4 illustrates a schematic view of inner conduit including a first set of orifices, in accordance with the embodiments of the present invention.

FIG. 4 illustrates a schematic view of inner conduit including a first set of orifices, in accordance with the embodiments of the present invention.

As illustrated, the first set of orifices 402 is located on the periphery of the inner conduit. In one example, the inner conduit 401 comprises two orifices located opposite to each other on the periphery thereof. In another example, the inner conduit comprises a plurality of orifices distributed along length (L) of the inner conduit.

The first set of orifices 402 is designed to dispense the first portion of the diluent/dispersion stream into the hydrocarbon stream at high velocity and at one or more pre-determined angles. In one example, the first set of orifices dispenses the first portion of dispersion/diluent stream in the range of 30 degree to 120 degrees. The first set of orifices 402 is located downstream the first annular space and at about the second annular space. The first set of orifices dispenses the first portion of diluent/dispersion stream into the thin film of hydrocarbon, which moves downwardly along the length of the inner conduit. It is to be understood that when the plurality of orifices are distributed along the length (L) of the inner conduit, the viscosity of the downwardly moving hydrocarbon film is progressively reduced due to dispensing of diluent/dispersion stream into the hydrocarbon film at multiple stages along the length (L) of the inner conduit.

The number of first set of orifices on the inner conduit depends on flow rate of diluent/dispersion stream.

FIG. 4 further illustrates that a portion 403 of the inner conduit downstream the first set of orifices may have a diameter lesser than the portion of inner conduit having the first set of orifices. The said diameter of the inner conduit downstream the first set of orifices is reduced to ensure high velocity of the second portion of the diluent/dispersion stream flowing through the inner conduit.

FIGS. 5 (*a*), 5 (*b*) and 5(*c*) illustrates various views of the sparging means 500, in accordance with the embodiment of the present invention.

The apparatus may comprise at least one sparging means 500 located downstream of the inner conduit and in fluid communication with the inner conduit. The sparging means 500 receive a second portion of the diluent/dispersion stream and dispense the second portion of the diluent/dispersion stream into the mixture comprising hydrocarbon stream and the diluent/dispersion stream. FIG. 5(*a*) illustrates an isometric view of the sparging means 500. As can be seen, the sparging means 500 comprises a plurality of outwardly extending arms 501 spaced apart at a pre-determined angle and defining a fluid passage there through. The sparging means 500 further comprises a second set of orifices 502 located on the periphery of said plurality of arms 501.

FIG. 5(*a*) illustrates four arms 501 spaced apart at an angle of 90 degrees. However, it is to be understood that there may be more or less number of arms spaced apart at different angles. In one example, the sparging means comprises two arms spaced apart at 180 degrees. In another example, three arms are spaced apart at 120 degrees. It is to be understood that many such combinations are possible. The said plurality of arms 501 terminates at the inner surface of the outer conduit. The plurality of arms 501 comprises a second set of orifices 502 located on a periphery thereof. FIGS. 5(*b*) and 5(*c*) illustrates a cross sectional view and axial view from the bottom of the sparging means 500 wherein the second set of orifices is located on a bottom surface 503 of the plurality arms. Although FIGS. 5 (*a*), 5(*b*) and 5(*c*) illustrates the presence of second set of orifices 502 on the bottom surface 503 of the plurality of arms 501, it is to be understood that the second set of orifices may be distributed on one or more: (i) the bottom surface 503 of the plurality of arms, (ii) an upper surface of the plurality of arms, and (iii) side surfaces of the plurality of arms.

The sparging means 500 are adapted for dividing the flow of the mixture comprising the diluent/dispersion stream and the hydrocarbon stream into at least a first flow and a second flow. The said mixture passes through the space between the pluralities of arms 501 and is divided into at least the first flow and the second flow. The sparging means 500 are further adapted to receive a second portion of the diluent/dispersion stream from the inner conduit and dispense the same into said at least a first flow and the second flow by means of the second set of orifices 502. The dispensing of the second portion of the diluent/dispersion stream into said first flow and second flow results in more uniform distribution and mixing of the hydrocarbon stream with the dispersion/diluent stream.

The diluent/dispersion stream can be introduced at various stages by means of a plurality of the sparging means. In one example, the second portion of the diluent/dispersion stream in dispensed through one sparging means. In another example, the second portion of the diluent/dispersion stream is divided into a plurality of the diluent/dispersion stream and is dispensed through a plurality of the sparging means. Each of the plurality of the sparging means is located downstream of the inner conduit and flow connected to the inner conduit to receive a portion of the diluent/dispersion stream.

FIG. 6*a* illustrates a schematic view of the outlet end of the outer conduit, thereby depicting the tip region of the apparatus. FIG. 6*b* illustrates a bottom view of the outlet end of the outer conduit, thereby depicting a bottom view of tip region of the apparatus.

As depicted by FIGS. 6*a* and 6*b*, the apparatus has a orifice 600 disposed at the boundary 601 of the tip region 602. Specifically, the orifice 600 is an opening provided on the boundary 601 in the shape of a slot, as depicted by FIG. 6*b*. In operation, the orifice 600 receives mixture comprising the hydrocarbon and diluent/dispersion stream. An emergence of the mixture out of the orifice 601 at a very high velocity individually atomizes the mixture. Specifically, the high velocity of the outgoing mixture contributes to formation of smaller size droplets of the liquid hydrocarbon feed present within the mixture. The orifice 600 acts as a gateway to lead the atomized mixture out of the apparatus. As mentioned before, the orifice 600 is in the form of the slot. In one example, the orifice 600 may be in the form a cylindrical notch. By virtue of the aforementioned geometrical design of the orifice 600, the outgoing and individually atomized mixture streams from the orifice 600 reinforce in one another to produce the flat fan shaped spray. The spray includes of a finely atomized droplets of the liquid hydrocarbon feed. In addition, the angle of the flat fan spray so produced depends upon a slot angle of the orifice 600. In one implementation, the slot angle of the orifice 600 is such that a flat fan spray having the spray angle between 60 degrees to 120 degrees is produced. This range of angle may be sufficient for the flat fan spray to cover the entire cross-section of a riser reactor. The spray so produced has all hydrocarbon feed droplets of identical diameter and uniformly distributed throughout the spray cross-section. In one implementation, a sauter mean diameter of the droplet within the atomized liquid hydrocarbon feed is achieved as 95-120 μm. In one example, there may me more than one orifice 600 that may be disposed at various elevations within the tip region 602. These multiple orifices 600 may be disposed at different elevations within the tip region 602 of the apparatus to produce a number of flat fan sprays. In such case, the orifices 600 may be disposed within the tip region 602 at various angles to one another for converging the multiple flat fan sprays on a single plane with or without overlapping to produce more uniformity in the droplet size and the droplet velocity distribution on the single plane. In one example, the apparatus of the present invention may be placed within the riser reactor at angle between 60 degrees and 90 degrees to the horizontal.

While certain present preferred embodiments of the invention have been illustrated and described herein, it is to be understood that the invention is not limited thereto. Clearly, the invention may be otherwise variously embodied, and practiced within the scope of the following claims.

The invention claimed is:

1. An apparatus for mixing and atomizing a hydrocarbon stream using a diluent/dispersion stream, said apparatus comprising:

an inner conduit having an inlet for receiving the diluent/dispersion stream;

an outer conduit having an inlet for receiving the hydrocarbon stream and an outlet for dispensing a mixture comprising the hydrocarbon and the dispersion/diluent streams;

said outer conduit concentric to the inner conduit to define at least a first annular space and a second annular space;

the first annular space being located downstream of the inlet of the outer conduit, said first annular space enabling formation of a thin film of the hydrocarbon stream between an outer surface of the inner conduit and an inner surface of the outer conduit;

the second annular space being located downstream of the first annular space, said second annular space having a width greater than a width of the first annular space; and the inner conduit located at about the second annular space comprises a first set orifices disposed on a periphery thereof for dispensing a first portion of the dispersion/diluent stream into the thin film of hydrocarbon stream to cross-shear the thin film and form the mixture comprising the hydrocarbon and the dispersion/diluent streams.

2. The apparatus as claimed in claim 1, wherein the first set of orifices dispense the diluent/dispersion stream at an angle in the range of 30 degree to 120 degree.

3. The apparatus as claimed in claim 1, further comprising at least one sparging means in flow connection with said inner conduit and located downstream of said inner conduit, the sparging means being adapted to divide the mixture into at least a first flow and a second flow and dispense a second portion of the diluent/dispersion stream into said at least first flow and second flow of the mixture.

4. The apparatus as claimed in claim 3, wherein sparging means comprises a plurality of outwardly extending arms spaced apart at a pre-determined angle, said plurality of arms defining a fluid passage there through and terminating at the inner surface of the outer conduit.

5. The apparatus as claimed in claim 4, wherein the sparging means includes a second set of orifices for dispensing the second portion of the dispersion/diluent stream into the at least first and second flow of mixture.

6. The apparatus as claimed in claim 5, wherein second set of orifices are provided on periphery of said plurality of arms.

7. The apparatus as claimed in claim 1, further comprising a flow diverter located downstream the inner conduit, said flow diverter adapted for dividing the mixture comprising the hydrocarbon and the dispersion/diluent streams into a plurality of streams.

8. The apparatus as claimed in claim 1, wherein a number of first set of orifices depends on flow rate of the diluent/dispersion stream.

9. A method for mixing and atomizing a hydrocarbon stream using a diluent/dispersion stream, said method comprising:

providing an apparatus comprising:

an inner conduit having an inlet for receiving the diluent/dispersion stream;

an outer conduit having an inlet for receiving the hydrocarbon stream and an outlet for dispensing a mixture comprising the hydrocarbon and the dispersion/diluent streams;

said outer conduit concentric surrounding the inner conduit to define at least a first annular space and a second annular space;

the first annular space being located downstream of the inlet of the outer conduit, said first annular space enabling formation of a thin film of the hydrocarbon stream between an outer surface of the inner conduit and an inner surface of the outer conduit;

the second annular space being located downstream of the first annular space, said second annular space having a width greater than a width of the first annular space; and the inner conduit located at about the second annular space comprises a first set orifices disposed on a periphery thereof for dispensing a first portion of the dispersion/diluent stream into the thin film of hydrocarbon stream to cross shear the film and form the mixture comprising the hydrocarbon and the dispersion/diluent streams;

introducing the diluent/dispersion stream into the inlet of the inner conduit; and introducing the hydrocarbon stream into the inlet of the outer conduit.

* * * * *